United States Patent [19]

Cotic

[11] Patent Number: 4,942,822

[45] Date of Patent: Jul. 24, 1990

[54] METHOD AND APPARATUS FOR AUTOMATICALLY SETTING RAIL TIE PLATES

[75] Inventor: Dennis J. Cotic, Waukesha, Wis.

[73] Assignee: Oak Industries, Inc., San Diego, Calif.

[21] Appl. No.: 203,328

[22] Filed: Jun. 7, 1988

[51] Int. Cl.[5] ..... E01B 29/20

[52] U.S. Cl. ..... 104/16; 104/5; 198/463.6; 198/532

[58] Field of Search ..... 104/2, 5, 16; 198/463.4, 463.6, 468.6, 532; 221/212, 258

[56] References Cited

U.S. PATENT DOCUMENTS

| | | | |
|---|---|---|---|
| 2,249,529 | 7/1941 | Knights | 198/463.6 |
| 3,433,966 | 3/1969 | Letch et al. | 250/223 |
| 3,882,785 | 5/1975 | Rowe | 104/16 |
| 3,943,858 | 3/1976 | Dieringer et al. | 104/16 |
| 4,178,671 | 12/1979 | Luttig | 29/429 |
| 4,241,663 | 12/1980 | Lund et al. | 104/16 |
| 4,280,613 | 7/1981 | Stewart | 198/406 |
| 4,393,784 | 7/1983 | Theurer | 104/2 |
| 4,727,989 | 3/1988 | Cotic et al. | 209/546 |

FOREIGN PATENT DOCUMENTS

| | | | |
|---|---|---|---|
| 433627 | 9/1926 | Fed. Rep. of Germany | 104/16 |
| 145026 | 7/1986 | Japan | 198/463.6 |
| 308954 | 3/1969 | Sweden | 310/198 |
| 315745 | 10/1971 | U.S.S.R. | 104/16 |
| 386049 | 10/1973 | U.S.S.R. | 104/16 |
| 509398 | 4/1976 | U.S.S.R. | 313/398 |
| 644897 | 1/1979 | U.S.S.R. | 104/16 |
| 652257 | 3/1979 | U.S.S.R. | 104/16 |
| 765445 | 9/1980 | U.S.S.R. | 104/16 |

OTHER PUBLICATIONS

"An Attraction for OTM", Railway Track and Structures, Mar. 1986, pp. 29–31.

*Primary Examiner*—Margaret A. Focarino
*Assistant Examiner*—Joseph Di Pape
*Attorney, Agent, or Firm*—Welsh & Katz, Ltd.

[57] ABSTRACT

A method and apparatus for automatically setting tie plates on tops of the ties for a railroad track includes a frame adapted to be moved along the track, an inclined slide surface adapted to accommodate a plurality of tie plates thereon, a plate control mechanism adapted to release the plates one at a time to slide down the slide surface and into a plate pocket where the plate is received by a reciprocating pusher which deposits the plate upon the top of a respective tie with a minimum of movement thereon so that the plate will be accurately positioned on the tie.

26 Claims, 5 Drawing Sheets

METHOD AND APPARATUS FOR AUTOMATICALLY SETTING RAIL TIE PLATES

BACKGROUND OF THE INVENTION

The present invention relates to machines for repairing or reconditioning railroad rights-of-way, and more specifically relates to a mechanism for automatically and accurately setting rail tie plates upon the upper surfaces of rail ties.

The invention disclosed in the present application is related to the invention disclosed in copending application Serial No. 07/203,328, filed June 7, 1988, titled "Automatic Tie Plate Sorting Conveyor," Ser. No. 07/224,486, filed July 26, 1988, titled "Automatic High Speed Tie Plate Reorienting System", Ser. No. 07/226,761, filed Aug. 1, 1988, titled "Automatic Tie Plate Setting Machine" and U.S. Pat. No. 4,727,989, titled "Automatic Tie Plate Orientation Sensing System".

Tie plates are used to secure rails to railroad ties and comprise a generally flat steel plate with a substantially flat bottom, spike holes and an upper surface having rail securing ribs. The tie plate upper surface is slightly angled to provide a rail seat canted inwardly, with more mass located on the field side of the plate to compensate for the force distribution of trains negotiating curves at high speed.

In the process of reconditioning railroad rights-of-way, the existing rail is removed along with the tie plates, the ties are replaced or resurfaced, and the track bed is refurbished. Before new rails are laid, replacement or recycled tie plates must be accurately positioned upon the ties.

Tie plate replacement is a cumbersome and labor intensive operation, due to the significant weight of the individual plates 18–40 pounds each) and the rapid rate at which they must be positioned to keep up with the other operations of track reconditioning, most of which are largely automated. It has been estimated that a member of a plate feeding crew will handle 150,000 pounds per eight hour shift. Accurate plate placement is critical, for the plates are required to be positioned within ¼ inch of an optimum location on the ties. In order to achieve this level of accuracy, a pregager machine with a registration edge follows the plate setting laborers to accurately position the plates upon the ties.

Previous attempts at automating the tie plate setting operation have resulted in devices which lack the capability of accurate placement at the rate of 30 to 40 plates per minute at which automatic tie plate setters must operate to keep up with other automated track maintenance equipment.

Accordingly, the plate setting mechanism of the invention is designed to set tie plates accurately to gage at high production rates in the range of at least 40 plates per minute. In addition, the machine is designed with a minimum of moving parts for greater reliability, can accommodate a large spectrum of tie plate size configurations, and may be integrated with a larger plate handling vehicle traveling at a constant speed over the rail bed.

SUMMARY OF THE INVENTION

A mechanism for setting tie plates on the upper surfaces of the ties for a railroad track is designed to store a plurality of tie plates in stacked linear arrangement, then to release the plates one at a time to slide down an inclined surface to a reciprocating pusher apparatus which pushes the plates individually from the mechanism and upon the upper surface of a respective tie at a zero forward velocity. In this manner, plate movement upon the tie is minimized and the plates are accurately positioned to gage upon the ties. The mechanism is capable of accurately setting tie plates at production rates in the range of at least 40 plates per minute.

More specifically, the mechanism includes a frame adapted to be moved along the track, an inclined slide surface mounted on the frame and adapted to accommodate a plurality of plates arranged seriatim thereon for sliding movement toward a pocket defined by the bottom end of the sliding surface, a plate stop assembly including at least one releasable stop for controlling the movement of the plates down the sliding surface toward the pocket, and a plate pusher assembly positioned near the pocket and including a reciprocating plate pusher member adapted to receive plates one at a time from the pocket and to push the plates individually upon the upper surface of a respective tie.

In a preferred embodiment, an electromagnet is positioned upon the frame just above the plate pocket. The electromagnet is adapted to receive individual plates from the slide surface and to retain each such plate prior to deposition thereof into the pocket for more rapid deposition of plates upon the ties.

DESCRIPTION OF THE PREFERRED EMBODIMENT

Figures 1, 2:
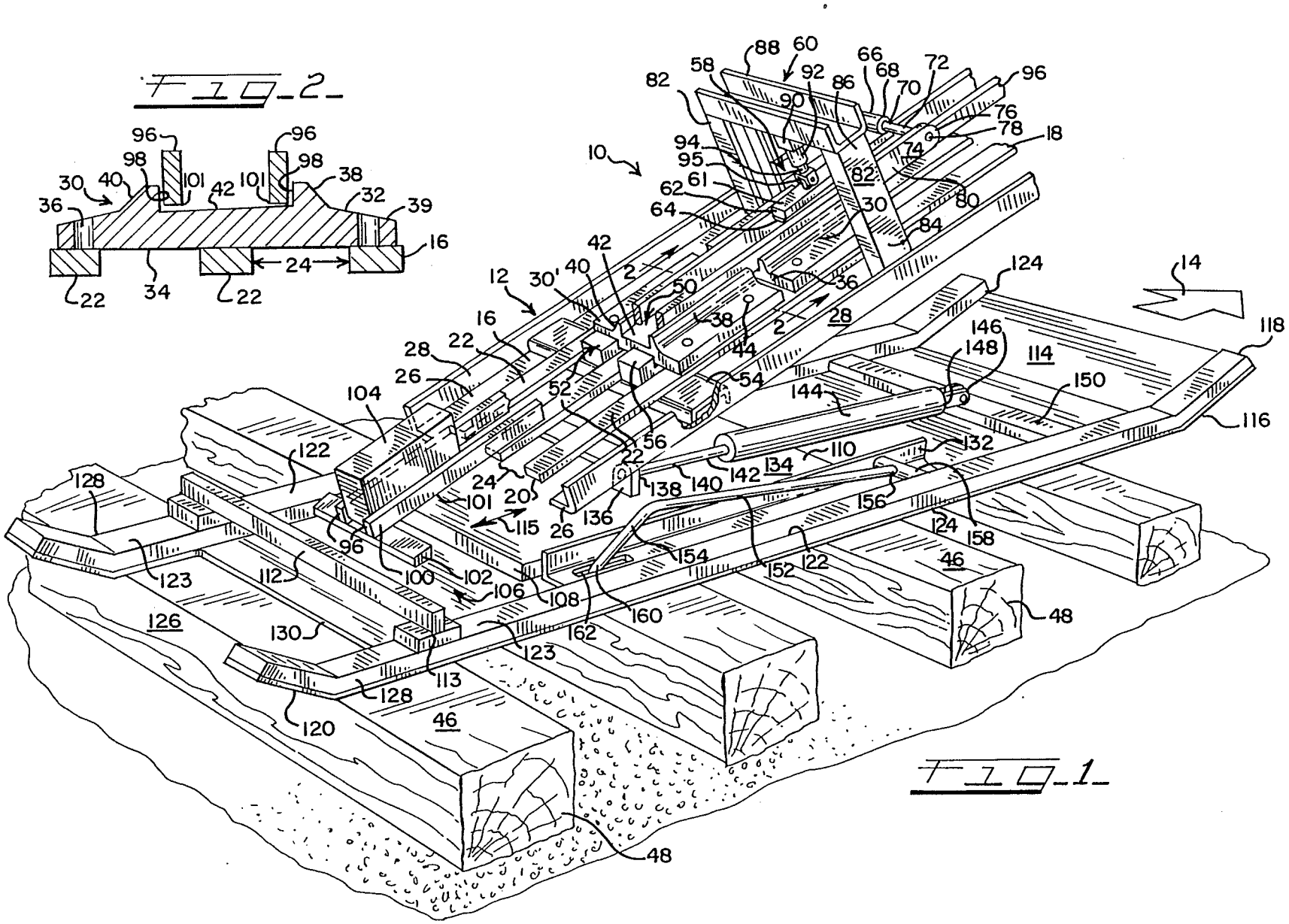
FIG. 1 is a fragmentary perspective elevation of the plate setter mechanism embodying the invention.
FIG. 2 is a sectional view taken along the line 2—2 of FIG. 1 and in the direction indicated generally.

Referring to FIG. 1, the plate setter mechanism of the invention is shown and designated generally by the reference numeral 10. The mechanism 10 may be designed to be mounted to a larger railway right-of-way repair machine (not shown). Other than as a source of propulsion of the mechanism 10, the railway repair machine is not relevant to the operation of the present invention and as such is not depicted or described in detail. The mechanism 10 includes a rigid frame 12 adapted to be integrally mounted to the machine so as to be moved along the track in the direction indicated by the arrow 14. The frame 12 includes a inclined slide surface 16 having an upper end 18 and a lower end 20 and is preferably formed from at least two elongate flat slide rails 22, each of which being spaced from each other by a distance 24. The surface 16 is provided with an angle iron member 26 on each side thereof positioned so that an upwardly projecting flange 28 serves as a guard rail which prevents the escape of tie plates 30 from the surface 16. Sufficient slide rails 22 are provided to provide the surface 16 with sufficient width to accommodate tie plates of varying dimensions.

Each tie plate 30 has an upper surface 32, a bottom 34 (best seen in FIG. 2), a front edge 36, a high side shoulder or rib 38 and a low side shoulder or rib 40. The high and low side shoulders 38, 40 to define a rail seat 42 (best seen in FIG. 2) into which the rail (not shown) is located. The rail seat 42 is normally canted from the high shoulder 38 to the low shoulder 40 to provide more mass to the plate 30 on the outer or field side 39 of the plate 30 to compensate for the force distribution of trains negotiating curves at high speed. The plates 30 are also provided with a plurality of spike holes 44 through which spikes (not shown) are inserted to secure the plates 30 to the upper surfaces 46 of the ties 48 in conventional fashion.

A plurality of plates 30 are located seriatim in linear stacked fashion upon the slide surface 16 and are backed up towards the upper end 18 of thereof. The tie plates 30 may be placed upon the surface 16 either manually or by a conveyor apparatus (not shown). A lowermost plate 30′ is retained in position 50 on the slide surface 16 between the upper and lower ends 18, 20 by a plate storage setter stop 52. The setter stop 52 includes a support member 54 upon which at least one vertically projecting block formation 56 is fixed. Each formation 56 is dimensioned to project through the space 24 between adjacent centermost rails 22 of the slide surface 16. The block formations 56 may be adapted to be releasably secured to said support member 54 by conventional features. The support member 54 is designed to be pivotally connected to the frame 12 at the pivot point 53 and to be subjected to a biasing force exerted by a hydraulic or other type of fluid power cylinder 55, preferably of the single-acting, spring return type (the pivot point 53 and the cylinder 55 best seen in FIGS. 4A–4E). The hydraulic cylinder 55 is connected at one end 57 thereof to the frame 12 and to the opposite end 59 thereof to the support member 54. The setter stop 52 is adapted to normally contact the front edge 36 of a lowermost plate 30′ and to pivot to retract the formations 56 below the surface 16 to allow the plates 30 to individually slide down the surface 16 as will be described in greater detail hereinbelow. The hydraulic cylinder 55 is designed to normally bias the setter stop 52 so that the formations 56 project through the spaces 24 to retain the lowermost plate 30′.

With the exception of the lowermost plate 30′, the remaining plates 30 stacked on the slide surface 16 are held in position by a plate storage stack stop 58 positioned above the surface 16 and mounted to a subframe 60 which is integral with the frame 12. The subframe 60 is located closer to the upper end 18 of the surface 16 than is the setter stop 52. The stack stop 58 includes an elongate stop member 61 having a free end 62 provided with an abrasion resistant plate contact surface 64. The abrasion resistant surface 64 may be designed to be releasable from the elongate stop member 61 for replacement purposes. The elongate member 61 also has a pivot end 66 with a journal bushing 68 mounted transversely thereto. The journal bushing 68 has a bore 70 dimensioned to slidingly engage a fixed pivot pin 72 to permit the member 61 to pivot thereon. The pivot pin 72 is fixed at each end thereof to the subframe 60 by means of a respective elongate arm member 74 at a free end 76 thereof, preferably by the mating engagement of the pin 72 with a bore 78 in the end 76. Although only one arm member 74 is depicted in FIG. 1, the pin 72 is secured at both ends by similar structure. The elongate stop member 61 is designed to travel a vertical pivot arc beneath the subframe 60.

Opposite the free ends 76 of the arm members 74, each end 80 thereof is fixed to a vertical stop support 82. The stop supports 82 each have a base 84 fixed to the angle iron support 26. The upper ends 86 of the stop supports 82 are spanned by a horizontal crossmember 88. For structural rigidity, the vertical supports 82 and the crossmember 88 may be sections of 'U'-shaped steel beams. A formation 90 located approximately midspan of the crossmember 88 and depending therefrom serves as the mounting base of a hydraulic cylinder 92 although other fluid power cylinders are contemplated. The cylinder 92 has a piston rod 94 pivotally secured to the elongate stop member 61 by a clevis assembly 95. The cylinder 92 is a single acting spring-return type cylinder adapted so that when the piston rod 94 extends, the contact surface 64 of the stop member 61 exerts sufficient pressure upon the plate 30 located behind the plate 30′ to maintain the position thereof upon the surface 16. After the setter stop 52 retracts and releases the lowermost plate 30′ to slide down the surface 16, the piston rod 94 retracts within the cylinder 92 and releases the clamped plate 30. The front edge 36 of the released second plate 30 then engages the formations 56 of the setter stop 52, which returned to their original position immediately after releasing the plate 30′. The sequential operation of the mechanism 10 will be described in greater detail herein below in relation to FIGS. 3A–3F and 4A–4E.

In the preferred embodiment of the invention, a pair of upper guide rails 96 are mounted to the frame 12 so as to be located above the slide surface 16 in parallel spaced relationship to each other. The rails 96 are arranged on the frame 12 so as to straddle the elongate stop member 61 and to slidingly engage the high and low side plate shoulders 38, 40 of the stacked plates 30 to resist lateral misalignment of the plates 30 upon the surface 16.

Referring to FIG. 2, the upper guide rails 96 are constructed and arranged so that each rail 96 is opposite the inner face 98 of the respective plate shoulder 38, 40. Depending on the size of the plate 30, the rails 96 may also slidingly engage the rail seat 42.

Referring now to FIG. the upper guide rails 96 project beyond the lower end 20 of the slide surface 16 and each have a lower end 100 which is fixed to a crossmember 102 of the frame 12. The crossmember 102 also serves as a plate stop, as will be described hereinbelow. An electromagnet 104 is mounted to the frame 12 in a position between the rails 96, adjacent the lower ends 100 thereof and is spaced slightly above the lower edges 101 of the rails 96. The electromagnet 104 is adapted to attract and retain individual plates 30 as they slide down the surface 16 upon release of the setter stop 52. The operation of the electromagnet 104 will be described in greater detail hereinbelow in relation to FIGS. 3A–3F.

Directly below the electromagnet 104 is located a setter drop pocket 106 defined by the contact end 108 of a pusher member 110, a sled plate stop 112, and a floor 114 of the sled 116. The plate stop 112 is mounted at each end thereof to a respective spacer block 113. The sled 116 is pinned to the frame 12 and includes the substantially planar floor 114 adapted for sliding movement across the upper surfaces 46 of the ties 48. The sled 116 also has upturned front and rear end portions 118, 120 respectively, which facilitate movement of the mechanism 10 across the ties 48. A pair of elongate side support bars 122 are fixed to the floor 114 at respective side edges 124 thereof, and are configured to conform to the upturned front and rear ends 118, 120 of the sled 116. The spacer blocks 113 are each located upon an upper surface 123 of the support bars 122.

A recess 126 in the floor 114 is formed at the rear end 120 of the sled 116 and is defined by the rear end portions 128 of the side support bars 122 and a rear edge 130 of the floor 114. The plates 30 are deposited upon the upper surfaces 46 of the ties 48 from the edge 130.

The pusher member 110 is a substantially rectangular block of rigid material and is positioned upon the floor 114 for reciprocal linear motion in the directions indicated by the double-headed arrow 115 between a pair of angle brackets 132, only one of which is visible in FIG. 1. The pusher member 110 operates between a retracted position (shown in FIG. 1) and an extended position (best seen in FIG. 3E). The pusher member 110 is adapted so that the contact end 108 intercepts the plates 30 and pushes them from the edge 130. A top surface 134 of the pusher member 110 is provided with a vertically projecting lug 136 centrally located thereon. The lug 136 has a rearwardly opening socket 138 adapted to receive the free end 140 of a hydraulic piston rod 142. The piston rod 142 is connected to the hydraulic cylinder 144 in conventional fashion, although other fluid power cylinders are contemplated. The cylinder 144 is of the single acting, spring-return type. A clevis assembly 146 is provided to couple the front end 148 of the hydraulic cylinder 144 to a front crossmember 150 at the approximate midpoint thereof.

An elongate tie sensor 152 includes a free end 154 and a pivot end 156. The pivot end 156 has a T-member 158 adapted to be pivotally connected to one of the angle brackets 132 and the corresponding side support member 122 for pivotal movement. The free end 154 has a depending angled portion 160 adapted to project through a slot 162 extending through the angle bracket 132 and the floor 114. The angled portion 160 is adapted to engage the ties 48. As the mechanism 10 travels in the direction indicated by the arrow 14, the upward pivoting action of the sensor 152 as the angled portion 160 encounters a tie 48 will trigger the operation of the plate setter mechanism 10 as described hereinbelow.

Figure 3A:
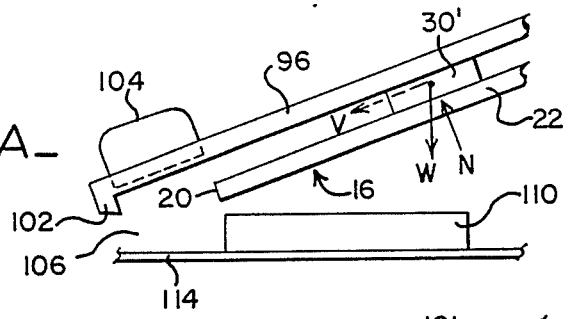
FIGS. 3A–3F are fragmentary side elevations of the plate setter mechanism depicted in FIG. 1 of the invention and diagrammatically depict the operational sequence of the electromagnet and pusher assemblies.

Referring now to FIGS. 3A–3F, the operation of the plate setter mechanism 10 equipped with the electromagnet 104 will be described. The components of the mechanism 10 are for the most part only conceptually illustrated to facilitate the explanation of the operational sequence. Referring to FIG. 3A, the lowermost plate 30' has been released from the setter stop 52 (best seen in FIG. 1) and is sliding down the slide rails 22 of the surface 16 at a velocity V. The weight W of the plate 30' is normally supported by the slide rails 22 which exert normal force N thereon. The upper guide rails 96, located between the plate shoulders 38, 40 (best seen in FIG. 2), prevent lateral misalignment of the plate 30' upon the surface 16. The pusher member 110 is shown in the retracted position.

Figure 3B:
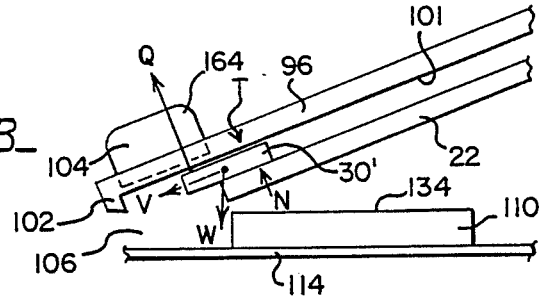

In FIG. 3B, the plate 30' is shown continuing down the surface 16 and encounters a transition zone T which includes the lower end 20 of the surface 16 and an uppermost portion 164 of the electromagnet 104. In the zone T, the electromagnetic force Q exerted by the electromagnet 104 lifts the plate 30' onto the lower edges 101 of the upper rails 96. The plate 30' is restrained from contacting the electromagnet 104 by the mounting of the electromagnet 104 slightly above the lower edge 101 of the upper rails 96.

Figure 3C:
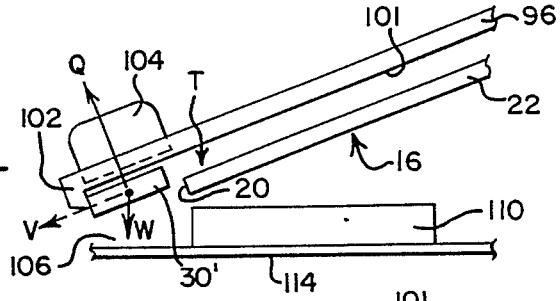

In FIG. 3C, the plate 30' continues to move downward, although its weight W is supported totally by the force Q exerted by the electromagnet 104. The lower or slide rails 22 are no longer needed at this point, and, since they would interfere with the subsequent dropping action of the plate 30' upon its release by the electromagnet 104, the rails 22 are truncated in the zone T.

Figure 3D:
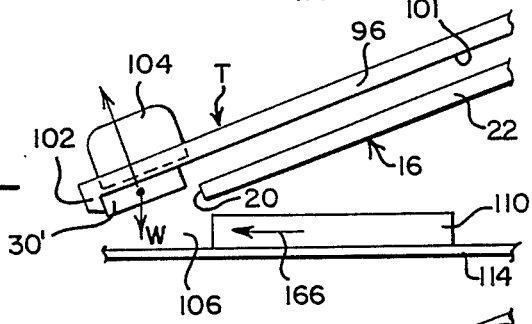

Referring to FIG. 3D, the forward velocity of the plate 30' continues until it impacts the crossmember/-stop 102. The plate 30' is now in the hold position, awaiting a 'drop' command from the setter electronic circuitry. In FIGS. 3A–3C, the pusher member 110 is in the retracted position, while in FIG. 3D the pusher member begins to move in the direction indicated by the arrow 166 toward the extended position.

Figure 3E:
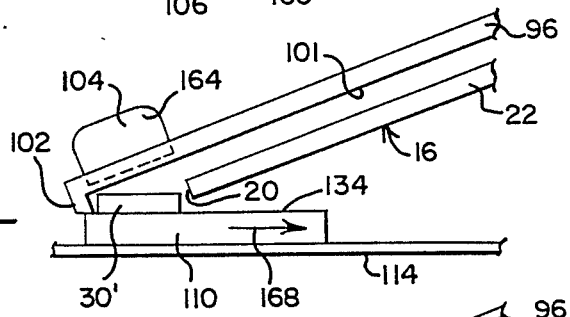

In FIG. 3E, once the pusher member 110 reaches the fully extended position, the pocket 106 is closed, and the electromagnet 104 is turned off, releasing the plate 30' onto the upper surface 134 of the pusher 110. The pusher member 110 then retracts in the direction indicated by the arrow 168. The plate 30' is retained in the pocket 106 by the lower end 20 of the surface 16.

Figure 3F:
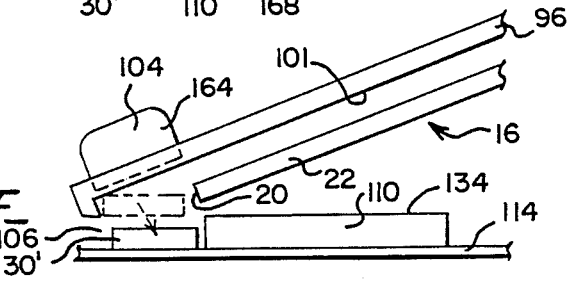

Referring to FIG. 3F, the pusher member 110 is fully retracted to its original position, and the plate 30' drops onto the floor 114 of the sled 116. At this point, the electromagnet 104 is turned on, allowing the release and transfer of the next plate 30 from the setter 52. The pusher member 110 will then move in the direction indicated by the arrow 166 to push the plate 30' from the edge 130 of the floor 114 and onto the upper surface 46 of the tie 48 (best seen in FIG. 1). The pusher member 110 pushes the plate 30' with a velocity equal and opposite to that of the sled 116. The plate 30' can be described as being set by the mechanism of the invention at a zero velocity. Thus, the pusher member 110 and the plate 30' are actually stationary with respect to the receiving tie 48.

It has been found that in the preferred embodiment of the invention depicted in FIGS. 1–3F, the plates 30 are deposited upon the upper surfaces 46 of the ties 48 at rates in the range of at least 40 plates per minute. Plate setting rates in this range are necessary for the automatic plate setter mechanism 10 to keep up with other automatic railway maintenance equipment when work is performed on a single rail gang basis, or one rail at a time. In this situation, work progresses more rapidly since the railway maintenance equipment uses the non-repaired rail as a gaging guide and, more importantly, with one less rail to work on, the work on a given segment of track may be accomplished in less time.

In applications where dual rail gangs are employed, or where both rails are repaired at once, the work progresses at an inherently slower pace. Thus, plate setter rates need only be half that required for single rail gang, or in the range of 20–25 plates per minute. An alternate embodiment of the plate setter mechanism of the invention designed for use in dual rail gang applications is conceptually depicted in FIGS. 4A–4E and is designated generally by the reference numeral 10'. The mechanism 10' shares most of the operational components with the mechanism 10, and these shared components retain the reference numerals previously designated. However, for purposes of operational simplicity and cost efficiency, the electromagnet 104 and the guide rails 96 are removed from the dual rail mechanism 10'. The other significant structural modification of the mechanism 10' is the addition of a depending stop 170 to the lower end 20 of the surface 16.

Figure 4A:
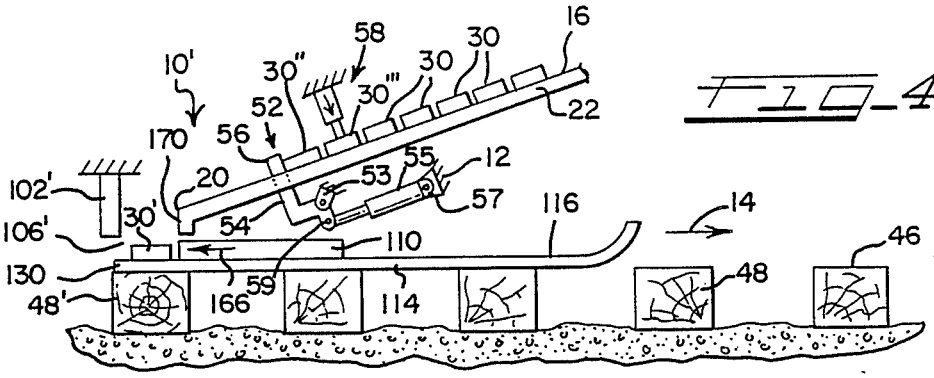
FIGS. 4A–4E are fragmentary side elevations of an alternate embodiment of the plate setter mechanism of the invention and diagrammatically depict the operational sequence of the plate stop and pusher assemblies.

Referring to FIG. 4A, the sled 116 is shown moving in the direction indicated by the arrow 14. The setter stop 52 is positioned to retain the second lowermost plate 30''', and the stack stop 58 is positioned to retain the third lowermost plate 30''' in position, and by so doing maintains the position of the remaining plates 30 upon the rails 22 of the surface 16. When the lowermost tie plate 30' is positioned in the pocket 106, and is directly above the tie 48', the mechanism 10' is ready to set the plate 30' and awaits the signal of the tie sensor 152 (best seen in FIG. 1) to trigger the plate setting cycle to begin.

Once triggered, the plate pusher member 110 begins pushing the plate 30' off the edge 130 of the sled 116 with a velocity equal and opposite to that of the sled 116. Thus, since the velocities of the pusher member 110 and the sled 116 are of the same magnitude but of opposite signs, the pusher member 110 and the plate 30' are actually stationary with respect to the tie 48'.

Figure 4B:
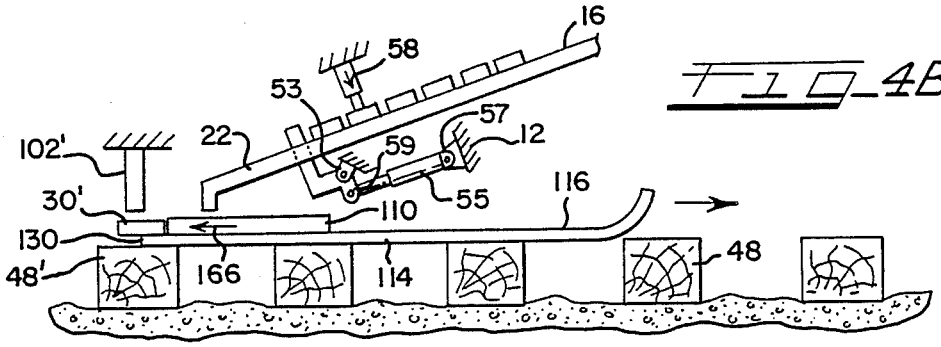

Referring to FIG. 4B, the plate 30' is shown halfway off the edge 130 of the sled 116 and is about to be set or dropped upon the upper surface 46 of the tie 48'. Due to the relative velocities and directions thereof described in relation to FIG. 4A, the sled 116 is actually pulled from under the plate 30', which remains stationary relative to the tie 48' as described hereinabove.

Figure 4C:
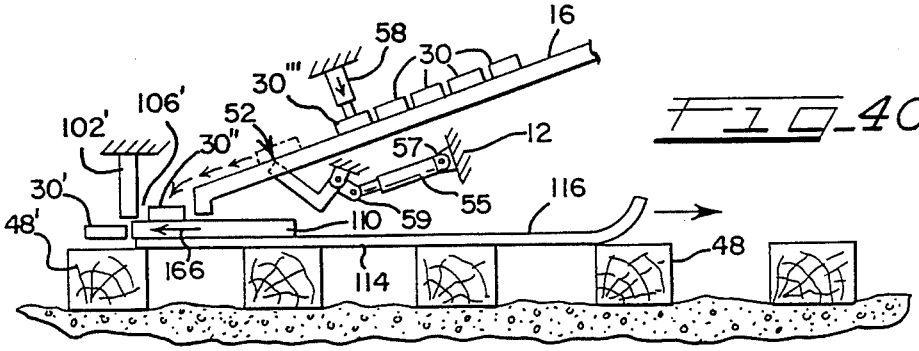

Referring to FIG. 4C, the plate 30' is deposited upon the upper surface 46 of the tie 48' when the sled 116 is totally removed from under the tie plate 30'. At the same time the plate 30' is thus deposited, the setter stop 52 releases the plate 30'' by the retraction of the formations 56, while the stack stop 58 retains the remaining plates 30 in stacked formation. The plate 30'' slides down the surface 16 and into the pocket 106', which is defined by the crossmember 102', the depending stop 170, and the upper surface 134 of the pusher 110.

Figure 4D:
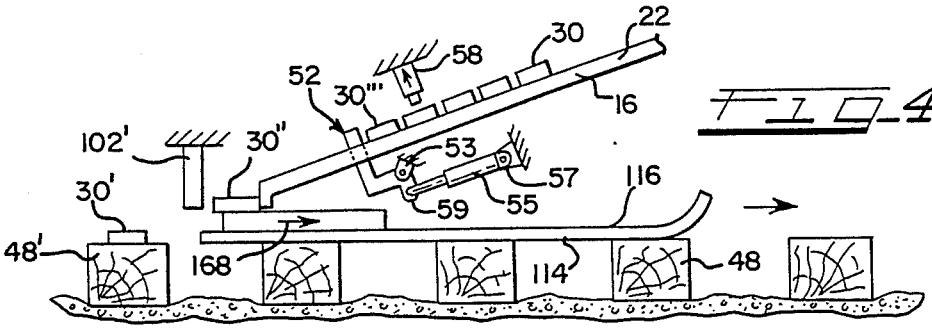

Referring now to FIG. 4D, once the plate 30'' is released by the setter stop 52, the stop 52 is pivotally returned to its original plate retaining position by the hydraulic cylinder 55. The stack stop 58 is then released to allow the remaining plates 30 slide down one position, so that a new lowermost plate 30''' abuts the setter stop formations 56. Once this plate 30''' is thus adjusted, the stack stop 58 is repressurized to prevent any further movement of the plates 30 down the slide surface 16. At the same time, the pusher member 110 is retracting in the direction indicated by the arrow 168. The plate 30'' is restrained from movement with the pusher member 110 by the depending stop 170, which holds the plate 30'' while the pusher member 110 retracts.

Figure 4E:
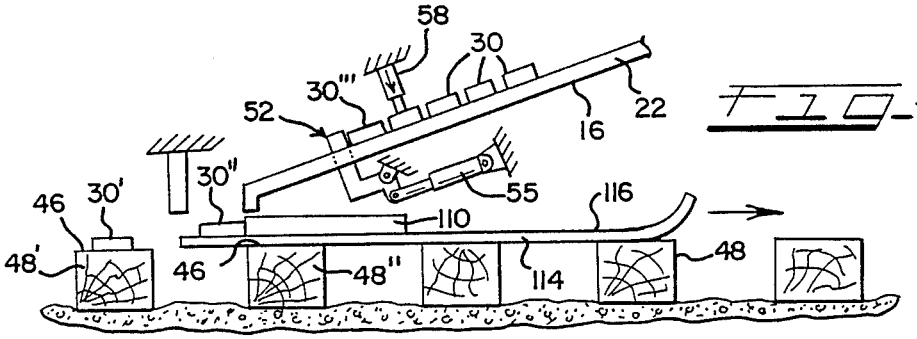

Referring to FIG. 4E, once the pusher 110 is fully retracted, the plate 30'' drops upon the sled floor 114 and is ready to be pushed from the edge 130 of the sled 116 onto the upper surface 46 of the next tie 48''. The entire cycle as depicted in FIGS. 4A–4D is then repeated for subsequent plates 30.

As indicated previously, the mechanism of invention may be provided in an embodiment adapted for use in a single rail gang, in which case the embodiment of FIGS. 1–3F hereinabove is employed, or alternately the mechanism of the invention may be provided for use in a dual rail gang, in the embodiment described in FIGS. 4A–4E hereinabove. The rate of operation in a dual rail gang is inherently slower than that for a single rail gang, with the rate of approximately 20–25 plates per minute for a dual rail plate setting gang being approximately half that for a single rail plate setting gang.

Figure 5:
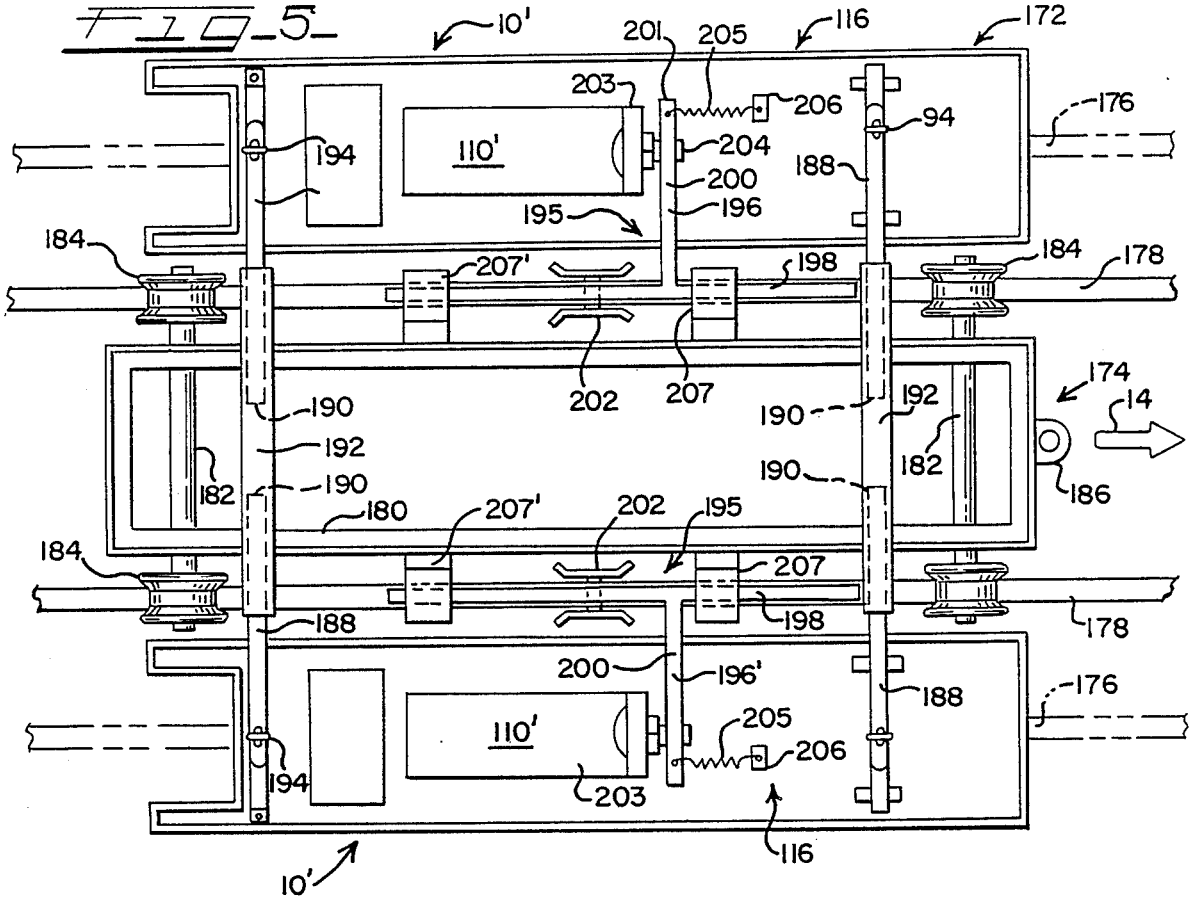
FIG. 5 is a diagrammatic plan view of a dual rail gang apparatus with a mechanism of the invention mounted on either side thereof for setting two sets of plate simultaneously.

Referring to FIG. 5, a dual rail gang plate setting assembly is depicted, and is designated generally by the reference numeral 172. The assembly 172 includes a pair of substantially identical plate setter mechanisms 10', each of which is secured to one side of a pull-along buggy 174. In a dual rail gang operation, the standard rails 176 are removed and a pair of relatively narrower gage temporary rails 178 are installed upon the same ties 48 (the ties best seen in FIG. 1). The buggy 174 is provided with a frame 180 to which a pair of axles 182 are secured in conventional fashion. A pair of rail wheels 184 are mounted to each axle 182 for freewheeling rotation thereabout, and are positioned thereupon to ride upon the temporary rails 178. The buggy 174 is provided with an eyelet 186 at one end of the frame 180 to enable the buggy to be pulled along the rails 178 by a powered vehicle (not shown) alternatively, the buggy 174 may be adapted to be an integral component of a rail plate setting machine (not shown). In FIG. 5, the eyelet 186 is positioned so that the buggy may be pulled in the direction indicated by the arrow 14.

Each of the plate setter mechanisms 10' is secured to the buggy 174 in the following manner. A transverse member 188 is mounted to the sled 116 adjacent to each of the crossmembers 102' and 150 (best seen in FIGS. 4A & 1 respectively) so that a free end 190 thereof projects laterally towards the buggy 174. The transverse members 188 ar dimensioned to telescopically engage a respective tubular member 192 transversely mounted to the frame 180 of the buggy 174. The free ends 190 of the transverse members 188 are adjustably secured within the tubular members 192 in conventional fashion using fastening bolts or pins (not shown). In addition, the transverse members 188 are adjustably secured to the frame 180 by releasable fasteners 194 so that the members 188 may be located upon the sled 116 to project beyond either side thereof, thus any particular sled 116 may be mounted to either side of the buggy 174.

Each mechanism 10' adapted for use in a dual rail gang may also be provided with a pusher member 110 which is operated by the hydraulic cylinder 144 as described hereinabove in relation to FIG. 1, or alternatively may be provided with a pusher 110' having a spring operated apparatus as depicted in FIG. 5 and designated generally by reference numeral 195. The apparatus 195 is designed so that the plates for each rail are deposited upon the same tie simultaneously. The apparatus 195 includes a pair of right and left 'T'-shaped linear reciprocating rods 196 and 196' respectively, each rod 196, 196' including an elongate portion 198 and a perpendicular extension 200. A releasable rail clamp 202 is attached to the elongate portion 198, while the pusher 110' is secured at the front end 203 thereof to the free end 201 of the extension 200 by a bolt or similar suitable fastener 204. A coiled extension spring 205 or suitable alternative spring is attached at one end to the extension 200 and at the opposite end to an upstanding lug 206 on the sled 116. Each elongate portion 198 is provided with front and rear bearing blocks 207, 207' respectively, the bearing blocks being located thereon so that the perpendicular extension 200 and the rail clamp 202 are located therebetween.

In operation, as the buggy 174 and attached setter mechanism 10' are pulled along the rail bed in the direction indicated by the arrow 14, pivotal movement of the tie sensor 152 (best seen in FIG. 1) upon interaction with a tie 48 triggers the rail clamps 202 of each mechanism 10' to clampingly engage the temporary rail 178. This clamping action stops the forward motion of the rods 196 and 196' as well as the pusher members 110', while the buggy 174 and the remainder of the mechanism 10' move in the direction indicated by the arrow 14. This relative motion of the sled 116 relative to the pusher 110' triggers the setting of a plate 30 within the pocket 106 and as described hereinabove in relation to FIGS. 4A–4E. After the buggy 174 and the mechanism 10' travel approximately one foot, and before the rear bearing block 207' impacts the clamp 202, the clamp 202 releases, allowing the spring 203 to retract, pulling the pusher 110' back to its retracted position as shown in FIG. 5. Thus, the apparatus 195 mounted to the respective mechanism 10' on each side of the buggy 174 is adapted so that plates for each rail are simultaneously deposited upon a respective tie.

Figure 6:
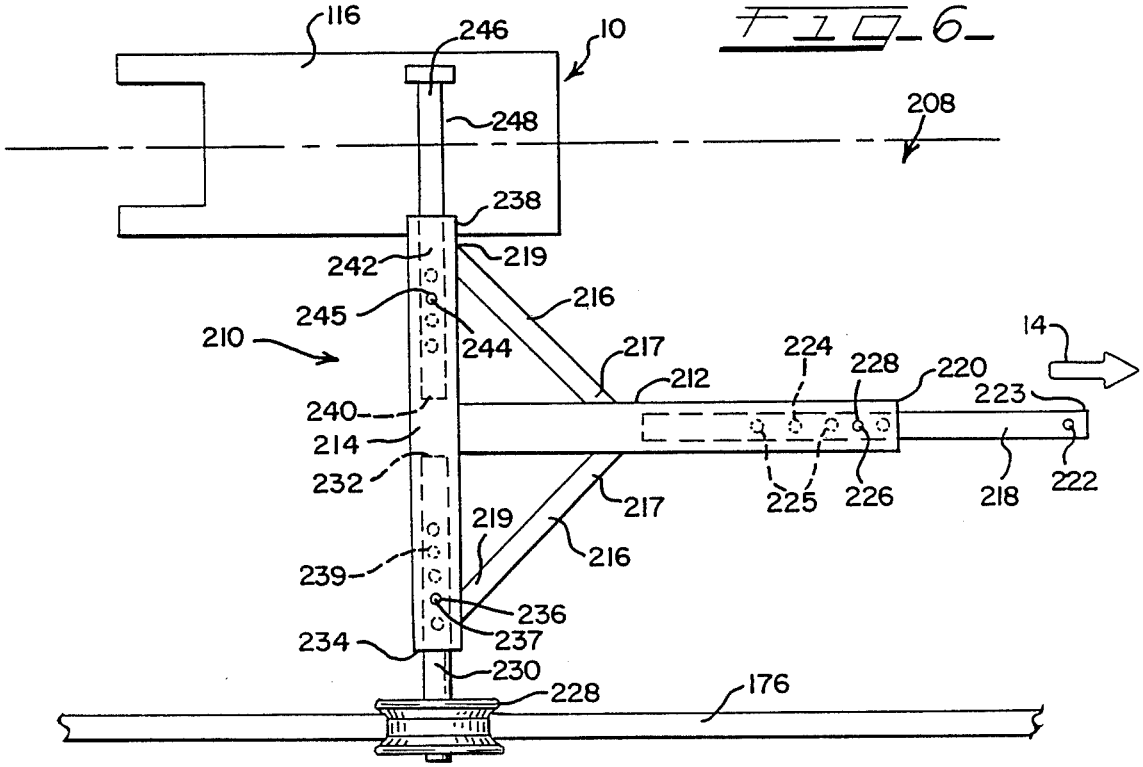
FIG. 6 is a diagrammatic plan view of a plate setting mechanism of the invention mounted to a single rail gang apparatus for setting one set of plates at a time.

Referring now to FIG. 6, a single rail gang assembly incorporating the mechanism 10 of the invention is depicted and is generally designated by the reference numeral 208. The assembly 208 includes a hollow 'T'-frame 210 provided with an elongate hollow member 212 and a hollow transverse member 214 fixed in perpendicular relationship thereto. A pair of support braces 216 are each fixed at one end 217 to the elongate member 212 and at the other end 219 to the transverse member 214. The elongate member 212 has an elongate tongue 218 inserted into a free end 220 thereof for telescoping action. The tongue 218 has an eyelet 222 at the end 223 thereof, by which a powered vehicle (not shown) may pull the assembly 208 in the direction indicated by the arrow 14. A central portion 224 of the tongue 218 has a plurality of spaced bores 225 therein through which a pin or bolt 226 may be inserted to secure the tongue 218 to the member 212. The pin 226 is designed to pass through a corresponding bore 228 in the member 212 as well as through a bore 225, and the length of the tongue 218 may be adjusted depending on through which tongue bore 225 the pin 226 is inserted. When the assembly 208 is not in use, the pin 226 may be removed and the tongue 218 may be retracted within the member 212 o completely removed therefrom to facilitate shipment of the entire assembly 208.

In a single rail gang operation, one of the rails is removed, and the remaining rail 176 serves as a guide rail for the rail maintenance equipment. Accordingly, a rail guide wheel 228, adapted to rotatably engage the remaining rail 176 is secured to an axle 230 for free-wheeling rotation thereabout. An end 232 of the axle 230 opposite the wheel 228 is inserted into an open end 234 of the transverse member 214 and the axle 230 may be secured therein with a pin and bore arrangement 236, 237 similar to pin 226 and bore 228 described hereinabove. The axle 230 may also be provided with a plurality of spaced bores 239, each adapted to receive the pin 236 for adjustment of the position of the wheel 228. The end 238 of the transverse member 214 opposite the end 234 is adapted to have an end 240 of the plate setter bar 242 inserted thereinto and to be retained therein by a pin and bore arrangement 244, 245 similar to the pin and bore arrangements 226, 228 and 236, 237 described hereinabove. In addition, a plurality of bores 247 is provided in the bar 242 to receive the pin 244 in similar fashion to the bores 225 and 239 described hereinabove. The end 246 of the plate setter bar 242 opposite the end 240 is releasably mounted to the sled 116 of the plate setter mechanism 10 by a suitable bracket 248. The bracket 248 is adapted so that the plate setter bar 242 may be mounted thereto to project from either side of the sled 116. Both the bar 242 and the axle 230 may be retracted within the transverse member 214 to facilitate shipment of the assembly 208 or alternatively may be selectively extended therefrom to adjust the assembly for operation on tracks 178 of a variety of gages. Further, the bar 242 and the axle 230 are adapted so that either component may be inserted into either end 234, 238 of the transverse bar 214 and thus enable the assembly 208 to be used on either rail 176, and to be pulled in the direction of travel indicated by the arrow 14.

Figure 7:
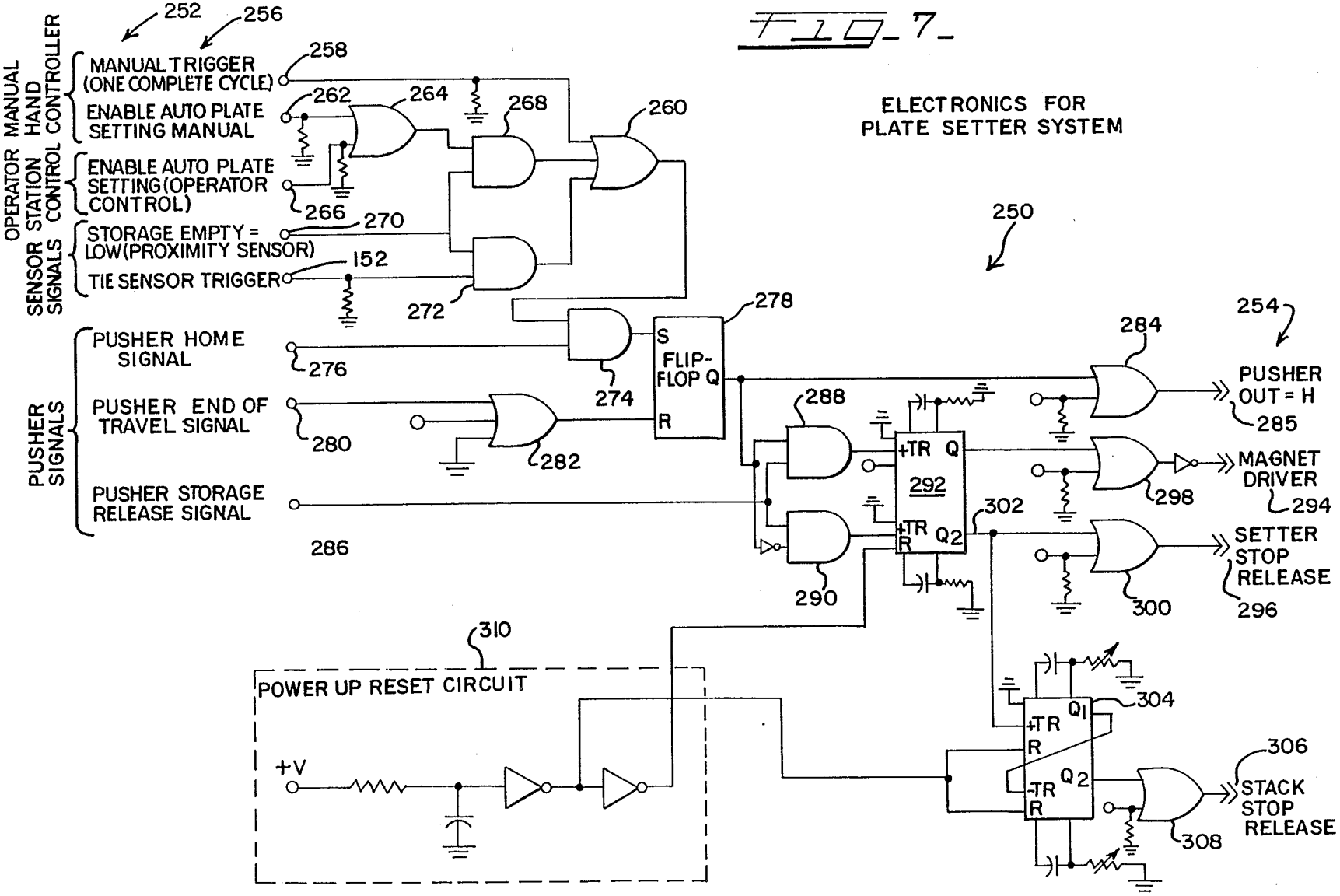
FIG. 7 is a schematic representation of the electronic circuitry of the present invention.

Referring now to FIG. 7, a schematic for the electronic circuitry of the plate setter mechanisms 10, 10' is depicted and is designated by the reference numeral 250. As depicted in FIG. 7, the circuit 250 includes a plurality of inputs 252 indicated on the left side of FIG. 7, and a plurality of outputs 254 indicated on the right side of FIG. 7. The inputs 252 include a manual hand controller 256 which is used for testing the mechanism 10, 10' when not in normal operation, or for clearing any jamming of the mechanism 10, 10' occurring during operation. The controller 256 has a manual trigger 258 connected to an 'or' gate 260, which, when activated, triggers the mechanism 10, 10' to complete one complete cycle thereof, as described in relation to FIGS. 4A–4E for the embodiment 10'. As described hereinabove in relation to FIGS. 1–3F, the preferred embodiment 10 operates with a similar cycle. The hand controller 256 also has a button or switch 262 which triggers the automatic plate setting function, or the action of the pusher 110 which sets a plate 30 upon the tie 48. The switch 262 is connected to an 'or' gate 264 which also may receive input from a switch 266 mounted on a rail maintenance vehicle (not shown) to which the mechanism 10, 10' is attached. The switch 266 is adapted to be under the control of the vehicle operator.

The 'or' gate 264 is connected to an 'and' gate 268 which may also receive input from a proximity sensor 270 adapted to indicate when additional plates are required on the surface 16. The sensor 270 is connected to the 'and' gate 268 and also to the 'and' gate 272, the latter adapted to also receive input from the tie sensor 152. The 'and' gates 268, 272 and the manual trigger 258 are all connected to the 'or' gate 260. Thus, any of the above-identified inputs 252 operating through the 'or' gate 260 may trigger the initiation of the operation cycle, i.e., the extension of the pusher 110 to push a plate 30 from the sled 116 and upon a upper surface 46 of a tie 48.

The pusher 110 is triggered in the following manner. The 'or' gate 260 is connected to an 'and' gate 274 which is adapted to receive input signals from a pusher home sensor 276 which indicates that the pusher 110 is in its fully retracted position (best seen in FIG. 4A). The 'and' gate 274 is connected to a conventional "flip-flop" 278 adapted to reciprocate between an 'on' position triggering the extension of the pusher 110, and an "off" position triggering the retraction of the pusher 110. When in the "on" position, the flip-flop 278 signals the hydraulic cylinder 144 (seen in FIG. 1) through the 'on' gate 284 and a solenoid 285 to extend the pusher 110.

The "off" position is signalled by a pusher end of travel sensor 280 connected to the flip-flop 278 through an 'or' gate 282. Once the sensor 280 senses that the pusher 110 is fully extended, the cylinder 144 is signalled to retract the pusher 110.

The remaining input 252 is the pusher storage release sensor 286, which triggers the release of the setter stop 52 to provide another plate 30 to the pusher pocket 106 or to the electromagnet 104. The sensors 276, 280 and 286 are preferably opto switches, but may alternatively be sensors of conventionally equivalent design. The pusher storage release sensor 286 is connected to each of a pair of 'and' gates 288, 290, both of which also receive input from the flip-flop 278. Thus, when the 'or' gate 284 is triggered to activate the pusher 110, the 'and' gates 288, 290 are also triggered alternately to activate the electromagnet 104 and the setter stop 52. The 'and' gates 288, 290 are also connected to a dual timer chip 292, adapted to appropriately trigger the electromagnet device 294 and, the setter stop release 296, each of which is activated through the respective 'or' gates 298, 300.

An output line 302 of the timer chip 292 is connected to a second dual timer chip 304, which, in turn is connected to the stacking stop release 306 through the 'or' gate 308. The second timer chip 304 is adapted to coordinate the operation of the stacking stop 58 with the setter stop 52. It should be noted that the outputs 285, 296 and 306 activate solenoid driven hydraulic valves operating the respective hydraulic cylinders 144, 55 and 92. A power up reset circuit 310 is connected to the timer chips 292 and 304 and to the 'or' gate 282 to reset the circuit 250 upon power up.

While particular embodiments of this apparatus have been described, it will be obvious to persons skilled in the act that changes and modifications might be made without departing from the invention in its broader aspects.

What is claimed is:

1. A mechanism for setting tie plates on upper surfaces of the ties for a railroad track, comprising:

a frame adapted to be moved along the track in a specified direction and having a front end and a rear end;

an inclined slide surface mounted on said frame, said slide surface having an upper end, a lower end disposed proximate to said frame rear end and adapted to accommodate a plurality of plates arranged seriatim for sliding motion thereon from said upper end toward said lower end;

releasable stop means located on said frame and adapted to regulate said movement of the plates on said slide surface to said lower end thereof said stop means releasing the plates seriatim down said slide surface;

a planar surface secured to said frame and having a portion disposed beneath said lower end of said slide surface; and plate pusher means located on said planar surface near the lower end of said slide surface and adapted to receive each of the plates seriatim as the plates drop from said slide surface, to retract to allow each dropped plate to fall upon said planar surface, and to push each of the plates from said planar surface upon the upper surface of a respective tie in a direction opposite to the direction of movement of said frame.

2. The mechanism of claim 1 further including sensing means mounted on said frame for sensing the position of the ties and actuating means designed to actuate said pusher means upon a signal from said sensing means.

3. The mechanism of claim 1 wherein said stop means includes a releasable plate setter stop mounted on said frame to engage a lowermost of the plates on said slide surface to control the sliding movement of the lowermost plate toward said pusher means.

4. The mechanism of claim 3 wherein said surface includes a plurality of parallel bars positioned to have spaces therebetween, said setter stop includes a support member mounted to said frame for controlled pivotal movement thereon and having at least one vertically projecting formation adapted to project through said spaces to engage the plates on said surface.

5. The mechanism of claim 4 wherein said formations are releasably mounted to said support member.

6. The mechanism of claim 4 wherein the pivotal movement of said support member is controlled by a hydraulic cylinder having two ends, said cylinder mounted at one of said ends to said frame and at a second said end to said support member.

7. The mechanism of claim 3 further including a releasable plate stack stop mounted on said frame closer to said upper end of said slide surface than said setter stop, said stack stop adapted to engage a second to the lowermost of plates on said slide surface to control the movement thereof toward said setter stop.

8. The mechanism of claim 7 wherein said stack stop includes an elongate stop member having first and second ends and positioned on a subframe above said slide surface, said first end pivotally secured to said subframe, said second end adapted to engage one of the plates, and said pivotal action of said stop member being controlled by a hydraulic cylinder having two ends and secured at one of said cylinder ends to said subframe and at a second of said cylinder ends to said elongate member.

9. The mechanism of claim 1 or claim 7 further including an electromagnet assembly constructed and arranged to receive each of the plates from said slide surface and to releasably retain the plates prior to deposition thereof upon said plate pusher means.

10. The mechanism of claim 9 wherein said electromagnet assembly includes an electromagnet unit mounted to said frame near said lower end of said slide surface and a pair of parallel guide rails spaced above said slide surface and extending parallel thereto toward said upper end thereof, said guide rails positioned to guide the plates to said electromagnet unit as they approach said lower end of said slide surface.

11. The mechanism of claim 1 wherein said planar surface is a sled designed to slide along said upper surfaces of the ties, said sled having a front end, a rear end and an upper surface, said rear end of said sled located adjacent said rear end of said frame and located beneath the lower end of said slide surface, said front end of said sled positioned closer to said front end of said frame, said pusher means being mounted to said upper surface of said sled for reciprocal linear movement thereon between a retracted position and an extended position.

12. The mechanism of claim 11 wherein said pusher means includes a pusher member having a front end, a rear end, and an upper surface adapted to receive the plates from said slide surface when said pusher member is in said extended position.

13. The mechanism of claim 12 wherein said lower end of said slide surface has a depending stop member designed to retain each of the plates in a static position on said upper surface of said pusher member as said pusher member moves towards said retracted position.

14. The mechanism of claim 12 wherein said pusher member is connected to the piston of a fluid power cylinder mounted to said frame, said cylinder adapted to effect said reciprocal movement of said pusher member.

15. The mechanism of claim 12 wherein said pusher member is connected to a rod member adapted for linear reciprocating motion relative to said sled, said relative motion effecting the reciprocal linear movement of said pusher member.

16. The mechanism of claim 15 wherein said rod member is T-shaped.

17. The mechanism of claim 15 wherein said rod member is provided with a rail clamp adapted to clampingly engage a rail to control the movement of said rod relative to said sled.

18. The mechanism of claim 17 wherein said pusher member is biased to return to said retracted position.

19. The mechanism of claim 18 wherein said pusher member is biased by a spring.

20. A mechanism for setting tie plates on upper surfaces of the ties for a railroad track, comprising:

a frame adapted to be moved along the track and having a front end and a rear end;

an inclined slide surface mounted on said frame, said slide surface having an upper end, a lower end and adapted to accommodate a plurality of plates arranged seriatim for sliding motion thereon toward said lower end, said lower end defining a plate pocket;

plate control means mounted on said frame and adapted to releasably control the movement of the individual plates on said slide surface toward said plate pocket;

an electromagnet assembly constructed and arranged to receive from said slide surface the plates individually released by said control means and to releasably retain each of the plates prior to deposition thereof into said pocket; and a plate pusher assembly located on said frame near the lower end of said slide surface and including a pusher member adapted for reciprocal linear movement on said frame, said pusher member adapted to receive the plates seriatim from said lower end of said slide surface and to push each of the plates from said rear end of said frame for placement upon the upper surface of a respective tie with a minimum of movement thereon so that the plates will be accurately positioned on the ties.

21. The mechanism of claim 20 further including sensing means mounted on said frame for sensing the position of the ties and sequentially actuating said plate control means and said pusher means.

22. The mechanism of claim 20 wherein said electromagnet assembly includes an electromagnet unit mounted to said frame near said lower end of said slide surface and having a pair of parallel guide rails spaced above said slide surface and extending parallel thereto toward said upper end thereof, said guide rails adapted to guide the plates to said electromagnet unit as they approach said lower end of said slide surface.

23. A method for setting tie plates upon the upper surface of ties for a railroad track, the method comprising:

stacking a plurality of the tie plates in linear fashion on an upper end of an inclined surface;

moving said surface along the track in a specified direction;

controlling the descent of individual plates as they slide down said surface and into a pocket, said pocket defined by a lower end of said surface and a sled member having a planar surface;

sensing the position of a tie by sensing means;

dropping each of the plates into the pocket upon a reciprocating pusher member; and pushing an individual plate from said sled member onto the upper surface of the sensed tie in a direction opposite the direction of movement of said surface and at a generally zero forward velocity.

24. The method of claim 23 further including controlling said descent of said plates by sequentially stopping the descent thereof to said pocket.

25. The method of claim 24 further including holding said individual plates above said pocket before the descent thereof into said pocket.

26. The method of claim 24 further including magnetically attracting the plates from said lower end of said surface and holding the plates above said pocket prior to allowing the plates to drop into the pocket.

* * * * *